United States Patent [19]

Karlsson

[11] Patent Number: 4,895,267

[45] Date of Patent: Jan. 23, 1990

[54] STORAGE UNIT, SUCH AS A LETTER TRAY OR A FILE HOLDER

[75] Inventor: Carina Karlsson, Älmhult, Sweden

[73] Assignee: Inter-Ikea A/S, Denmark

[21] Appl. No.: 186,630

[22] Filed: Apr. 27, 1988

[30] Foreign Application Priority Data

Apr. 30, 1987 [DK] Denmark ..... 2216/87

[51] Int. Cl.[4] ..... B65D 6/18

[52] U.S. Cl. ..... 220/4 F; 220/6; 220/67

[58] Field of Search ..... 220/4 F, 6, 67

[56] References Cited

U.S. PATENT DOCUMENTS 3,047,183 7/1962 Papa ..... 220/4 F 3,651,975 3/1972 Callan ..... 220/4 F 4,673,087 6/1987 Webb ..... 220/4 F

FOREIGN PATENT DOCUMENTS 1180303 5/1961 Fed. Rep. of Germany ..... 220/4 F

*Primary Examiner*—Robert G. Nilson

[57] ABSTRACT

A storage unit, such as a letter tray or a file holder, preferably of plastics, and comprising a bottom member and at least two side members. The storage unit is characterized in that the bottom member is connected to the side members by means of snap locks. The side members can also be interconnected by means of snap locks. The storage unit is particularly secure and stable and has simultaneously an attractive appearance.

1 Claim, 4 Drawing Sheets

STORAGE UNIT, SUCH AS A LETTER TRAY OR A FILE HOLDER

FIELD OF THE INVENTION

The invention relates to a storage unit, such as a letter tray or a file holder, preferably of plastics, and comprising a bottom member and at leat two side members.

BACKGROUND ART

German Offenlegungsschrift No. 23 44 874 discloses a distribution box particularly for writing materials. This box comprises two halves, each half being manufactured in one piece and including a side member, a portion of the bottom member, and a portion of the rear member. In the bottom this box is provided with projections and barbs allowing an assembling of the two halves of the box. The projections and the barbs allow the width of the box to be adjustable. This distribution box is, however, encumbered with the drawback that when it is not used it can only be separated and not completely folded up. When this distrubtion box is used, the projections and the barbs do not provide said box with a sufficient strength and solidity.

The German Auslegeschriften Nos. 18 15 376 and 22 09 280 disclose file holders comprising differently shaped webs and flaps, and where the file holders are made of cardboard or another inexpensive non-resilient material. These holders are encumbered with the drawback that they are not very strong nor dimensionally stable.

SUMMARY OF THE INVENTION

The object of the present invention is to provide a storage unit of the above type which compared to the known trays is more dimensionally stable and of a higher strength when assembled, i.e. in use, as well as it takes up less room when not assembled, i.e. when in stock or during transport.

The storage unit according to the invention is characterized in that the bottom member is connected to the side members by means of snap locks. As a result the bottom and side members can be interconnected in a very simple manner when the storage unit is to be assembled, whereby the individual members cannot wriggle relative to one another.

According to a preferred embodiment the hooks of the snap locks are situated on the side members, whereby the storage unit is easy to catch hold of when two storage units are situated side by side as the side members do not abut one another in this position of the units.

According to the invention the hooks of the snap locks may be situated on the bottom member, whereby the side members can form legs of the storage unit. As a result the storage unit is less sensitive than previously towards unevennesses in the surface therebelow.

Moreover according to the invention the side members not being interconnected by means of snap locks may be interconnected by means of film hinges. In this manner the side members can be bent on the correct locations so as to form a tray although they are manufactured in one piece of preferably rigid plastics.

According to the invention the side members may be interconnected by means of snap locks keeping the tubular portion of the tray together as a defined unit.

Moreover according to the invention the bottom member may comprise groove-forming means receiving the side members, whereby the assembled storage unit is provided with a high strength and the individual members can be mutually tightened.

According to the invention it is also possible to provide groove-forming means in the side members, said means receiving the bottom member. As a result the assembled storage unit possesses a high strength.

In addition according to the invention the snap locks may comprise two substantially parallel and mutually spaced hooks as well as two corresponding counterparts, which provides the locking of the side member to the bottom member with the maximum strength.

When the storage unit comprises hooks including projections, said projections may according to the invention be undercut, whereby the strength of the locking of the side member to the bottom member is additionally improved.

BRIEF DESCRIPTION OF DRAWINGS

The invention will be described below with reference to the accompanying drawings, in which.

DESCRIPTION OF PREFERRED EMBODIMENTS

Figure 1:
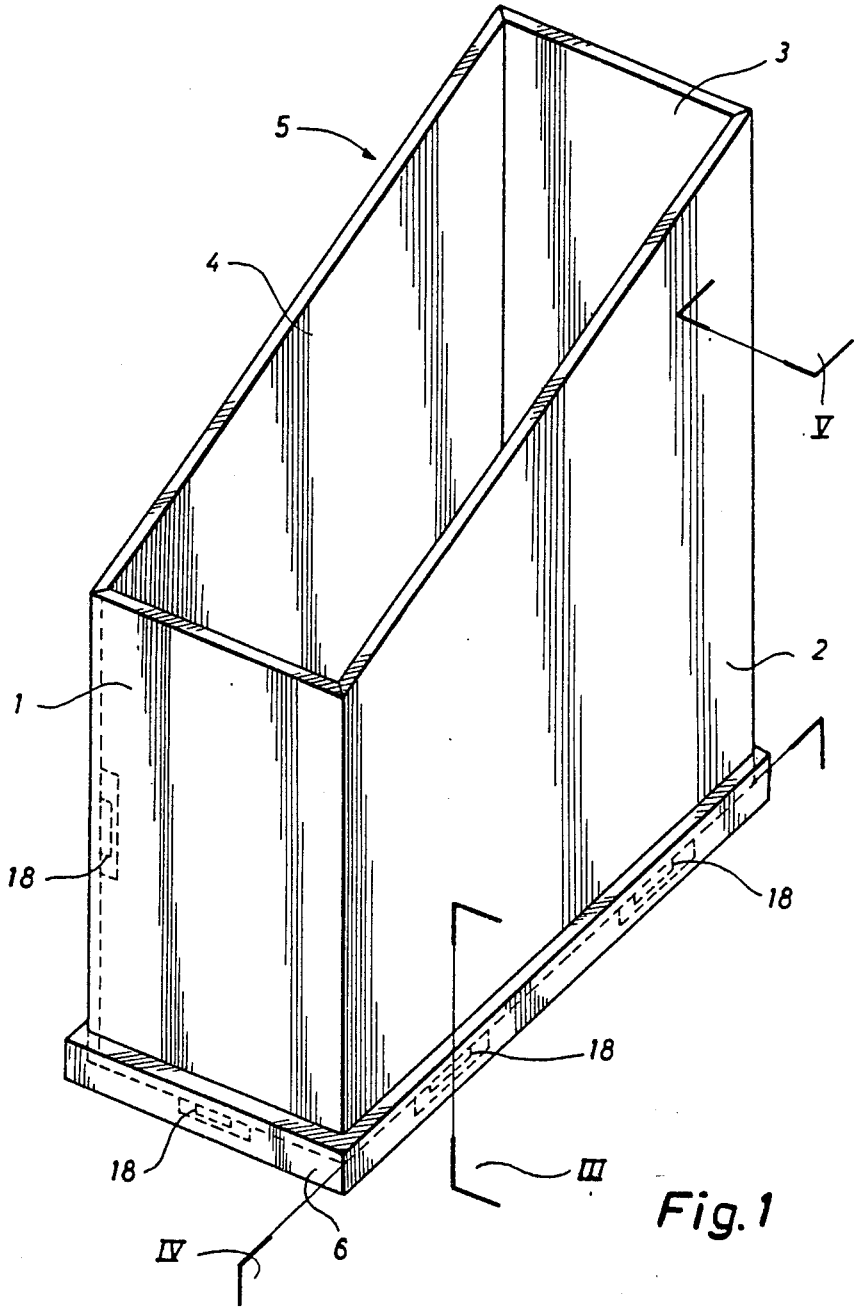
FIG. 1 is a perspective view of a storage unit in the form of a file holder.

FIG. 1 illustrates a storage unit designated 5 in the form of a file holder. The file holder comprises a bottom member 6 and four side members 1, 2, 3, and 4. The file holders are generally used for the storage of for instance papers and magazines and are available in many shapes. Such file holders have a tendency to gradually lose their shape. The file holder according to the invention can be manufactured of materials presenting on one side a low weight and a small volume during transport and simultaneously being of a high strength and solidness when used. As a result the file holder has always an attractive appearance during its entire service life. The bottom member is secured to the side members by means of snap locks 18 described more detailed below in connection with FIG. 3.

Figure 2:
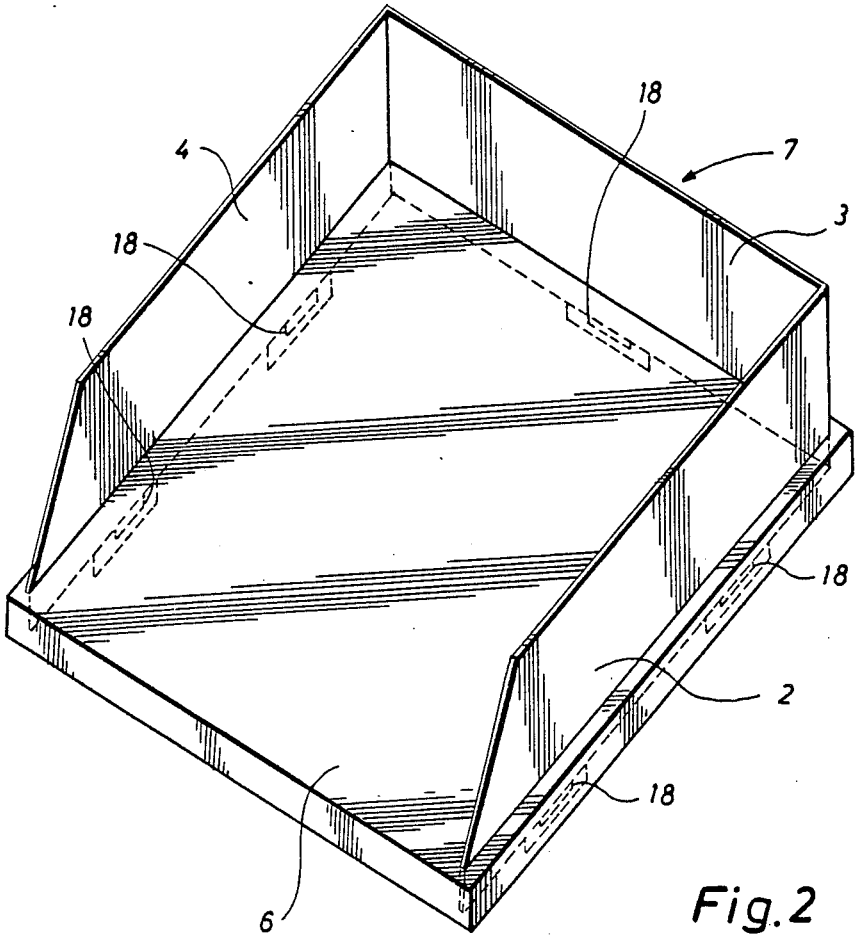
FIG. 2 is a perspective view of a storage unit in the form of a letter tray.

FIG. 2 illustrates a storage unit designated 7 in the form of a tray for letters or the like articles. The tray comprises a bottom member 6 and three side members 2, 3, and 4. Unlike the file holders the letter trays are often open in two sides, said file holders only being open in one side. Therefore the letter trays must often be manufactured of a stronger material than the file holder because the structure itself does not provide a sufficient strength. The letter tray according to the invention possesses the advantage that it can be demounted and takes up very little room during a transport. Simultaneously it possesses a high strength when it is assembled. The bottom member 6 of the tray can be provided with known means allowing the trays to be piled both atop one another and displaced relative to one another in such a manner that the contents of the tray is more or less visible. The letter tray is available in many sizes and embodiments. It can for instance be adapted to various inserts or for instance pads or diaries, cf. below in connection with FIG. 7. The bottom member 6 is secured to the side members 2, 3, and 4 by means of snap locks 18.

Figure 3:
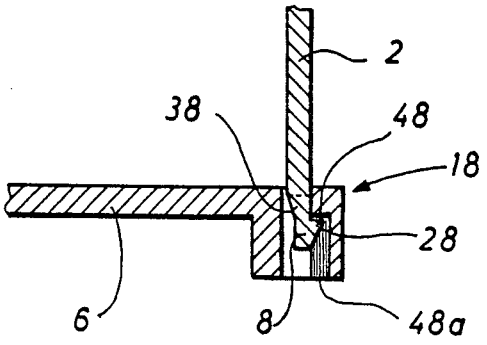
FIG. 3 is a cross-sectional view along the plane III of FIG. 1 of an embodiment of a snap lock.

FIG. 3 illustrates a snap lock 8 engaging the bottom member 6. The snap locks used according to the invention may be shaped in many different ways. They may for instance be of a type being releasable after the parts thereof have been interconnected, or of a type where the interconnected parts are not releasable. Each snap lock can be situated in such a manner that its hook 8 is situated on the side member or vice versa, i.e. the hook is situated on the bottom member. Whether the hook is to be situated on the bottom member or on the side member depends usually on whether the bottom member or the side member is to form legs for the storage unit. When the bottom member is to form legs for the storage unit, said bottom member can be subjected to a bending effect which unfortunately implies that the hooks of the snap locks can work loose gradually. Therefore a snap lock of the non-releasable type is used in the latter case.

Figure 4:
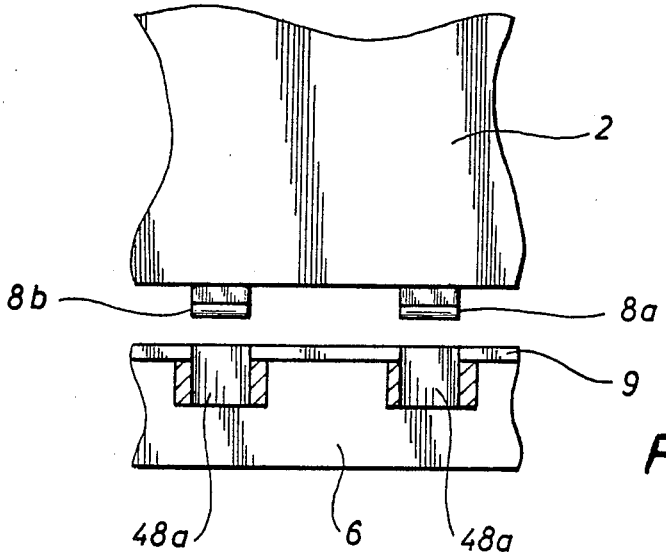
FIG. 4 illustrates a snap lock between the side member and the bottom member when demounted, said FIG. being a vertical view along the plane IV of FIG. 1 of the bottom member.

FIG. 4 illustrates how the side member 2 fits in the bottom member 6, and how the two hooks 8*a* and 8*b* are situated side by side. FIG. 4 illustrates also how the bottom member comprises a groove-forming means 9. As the side member can enter the groove 9, the groove-forming means provides the unit with an additional strength. When the hooks 8 are situated in the bottom member, the groove must be situated in the side members.

Figure 5:
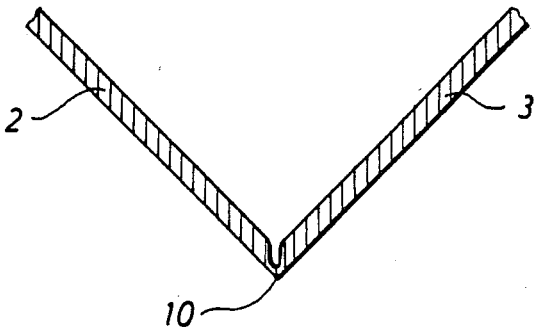
FIG. 5 illustrates a film hinge between two side members, said FIG. being a horizontal view along the plane V of FIG. 1 of the side members.

FIG. 5 illustrates an example of how two side members 2 and 3 are interconnected by means of a film hinge 10. The film hinges provide the unit with a good strength at the same time as it is possible to fold up the unit when it is not used. A suitable internal or external placing of the film hinges allows a folding up of the portion of the storage unit carrying the film hinges, the film hinge 10 being externally placed. As a result the storage unit takes up minimum room for instance during transport. The film hinges are furthermore advantageous by being easy to manufacture through injection moulding when the entire storage unit is made of plastics.

Each snap lock, i.e. hook, can comprise a vertical portion 38 and a projection 28, cf. FIG. 3. The hook 8 can co-operate with a counterpart 48 provided with an opening 48a. As indicated the projection 28 can be undercut.

Figure 6:
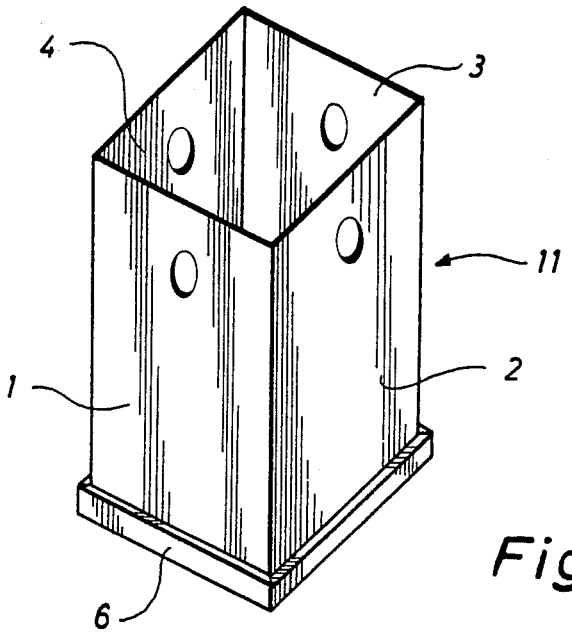
FIG. 6 is a perspective view of a storage unit in the form of a wastepaper basket.

FIG. 6 illustrates a storage unit in the form of a wastepaper basket 11. The basket comprises a bottom member and four side members 1, 2, 3, and 4. The side members are identical, especially as far as the location of the snap locks is concerned. The size of this embodiment can vary from for instance small storage units placeable on a desk for for instance writing materials or clips and up to large storage units, such as wastepaper baskets. When the side members are identical in pairs and the bottom member is suitably shaped, a storage unit of a different cross section than illustrated, such as rectangular, is achieved.

Figure 7:
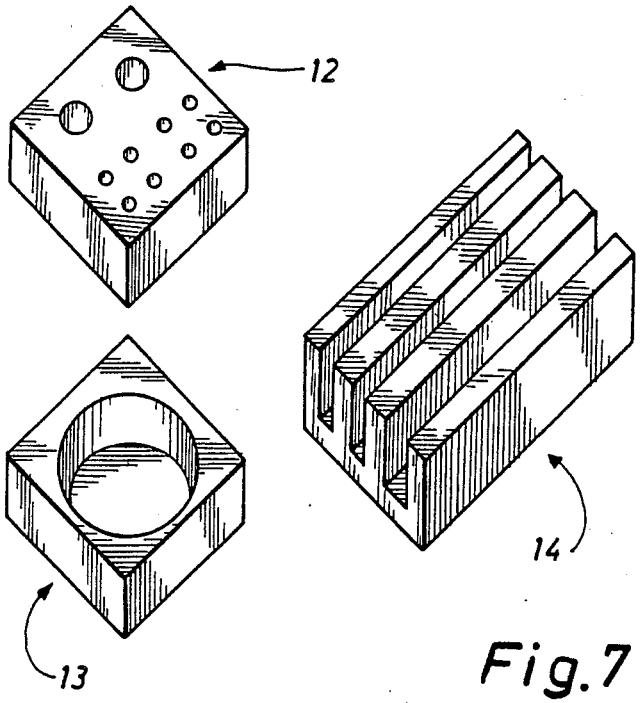
FIG. 7 illustrates three inserts for a tray.

FIG. 7 illustrates various inserts insertable in the tray 7. The penholder 12 can be used for the storage of writing materials and for instance ink eradicator or blanco fluid. The insert 13 for small articles can be used for the storage of for instance eraser and clips. The letter tray 14 can be used for the storage of papers, letters, diaries etc. All the inserts are made of preferably soft plastics or rubber, and they all fit in a storage tray.

The invention is not limited to the above embodiments, but may be modified in many ways without thereby deviating from the scope of the invention. Thus it is possible to connect the bottom member and the side members by means of very few snap locks and many film hinges or, if desired, to connect the bottom member and the side members by means of snap locks only.

I claim:

1. A storage unit formed as a letter tray made of plastics and comprising a bottom member and at least two side members, the bottom member being connected to the side members by means of two snap locks provided along each longitudinal side at the bottom member, wherein groove-forming means receiving the side members are provided in the bottom member, the snap locks being undercut hooks cooperating with horizontal ribs projecting from the walls of recesses formed in the bottom member, said undercut hooks having projections facing away from the middle of the storage unit and the rear side of said hooks facing towards the middle of the storage unit being undercut, and at least two of the side members are interconnected by means of film hinges.

* * * * *